US005512111A

United States Patent [19]

Tahara et al.

[11] Patent Number: 5,512,111

[45] Date of Patent: Apr. 30, 1996

[54] ALUMINUM ALLOY MATERIAL FOR SHUTTER OF RECORDING MEDIUM CASSETTE, PROCESS FOR PRODUCING THE SAME, AND ALUMINUM ALLOY SHUTTER MADE OF THE SAME

[75] Inventors: Shozo Tahara, Nara; Taizo Kimura, Kanagawa; Hiroki Miyazaki, Ichikawa; Kazuhiro Hanaki, Nagoya, all of Japan

[73] Assignee: Sumitomo Light Metal Industries, Ltd., Tokyo, Japan

[21] Appl. No.: 227,551

[22] Filed: Apr. 14, 1994

[30] Foreign Application Priority Data

Apr. 14, 1993 [JP] Japan ..... 5-112274
Jul. 21, 1993 [JP] Japan ..... 5-201020

[51] Int. Cl.[6] ..... C22C 21/06

[52] U.S. Cl. ..... 148/440; 148/537; 148/417; 148/439; 360/106

[58] Field of Search ..... 148/688, 691, 148/692, 696, 697, 700, 417, 440, 693, 247, 264, 275, 537, 439; 420/533, 542, 543, 545; 427/388.1, 409, 416; 360/99.06, 99.07, 104, 105, 106

[56] References Cited

U.S. PATENT DOCUMENTS 3,787,246 1/1974 Tagai et al. ..... 148/537
4,115,607 9/1978 Hasegawa et al. ..... 148/537
4,994,121 2/1991 Sobata et al. ..... 148/251
5,062,901 11/1991 Tanaka et al. ..... 148/692
5,125,989 6/1992 Hallman ..... 148/247
5,235,481 10/1993 Kamo et al. ..... 360/106

*Primary Examiner*—David A. Simmons
*Assistant Examiner*—Robert R. Koehler
*Attorney, Agent, or Firm*—Flynn, Thiel, Boutell & Tanis

[57] ABSTRACT

An aluminum alloy material for the shutter of flat recording medium cassettes. The shutter is light in weight and smoothly slidable, has good corrosion resistance and durability, and protects itself against staining with fingerprints. The aluminum alloy contains 3.0–6.0% Mg (by weight) and one or more than one optional elements of Mn≦1.5%, Cr≦0.3%, Cu≦0.5%, and Ti≦0.1%, with the balance being aluminum and inevitable impurities, and has a tensile strength of 310–410 MPa and a yield strength of 250–370 MPa. The aluminum alloy material is formed from a rolled sheet of said aluminum alloy by coating the sheet with a plastic film not thicker than 5 μm. The rolled sheet undergoes intermediate annealing at higher than the recrystallization temperature, final cold rolling, and stabilizing heat treatment.

6 Claims, 1 Drawing Sheet

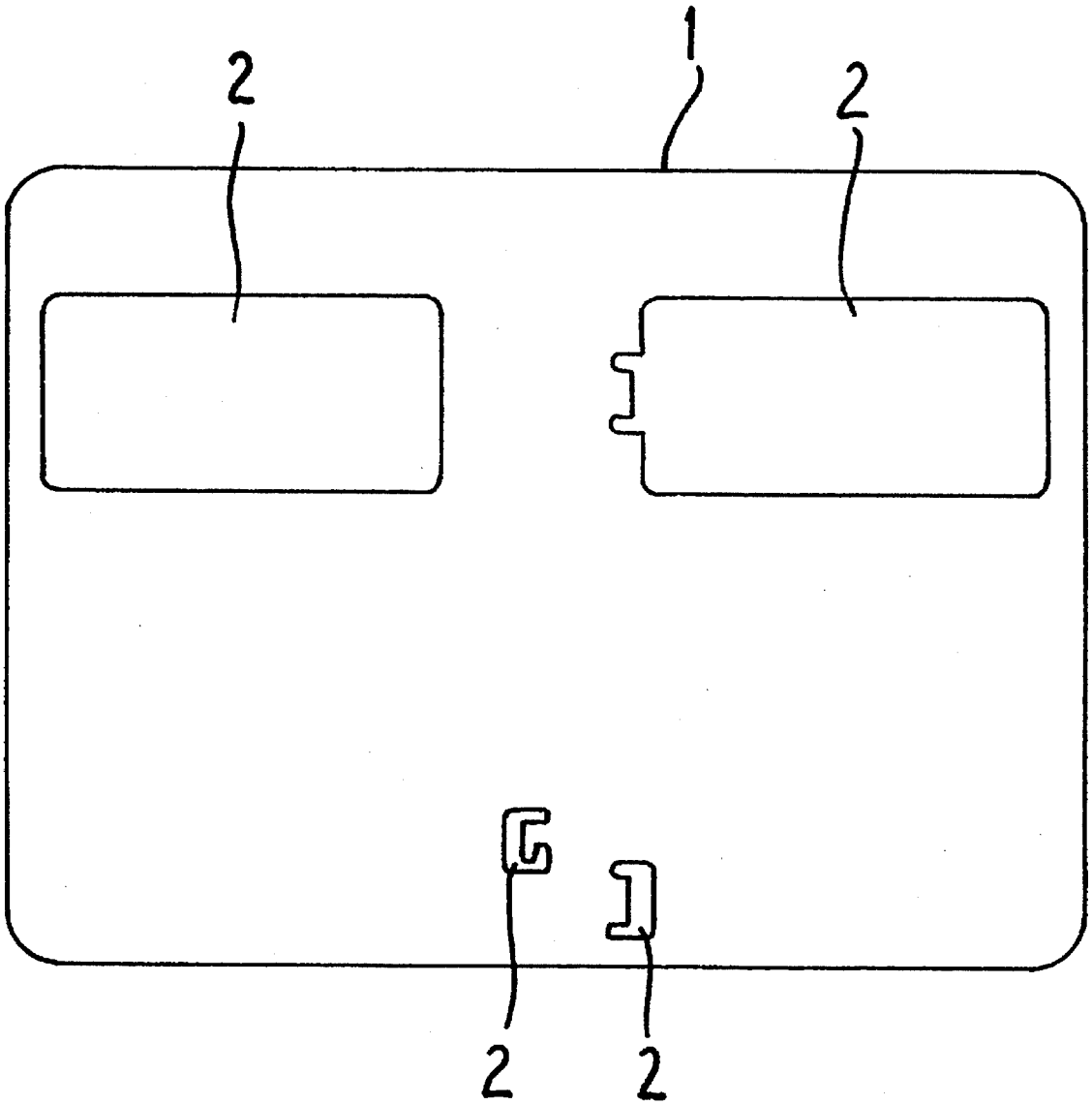
1
2
2
2
2

ALUMINUM ALLOY MATERIAL FOR SHUTTER OF RECORDING MEDIUM CASSETTE, PROCESS FOR PRODUCING THE SAME, AND ALUMINUM ALLOY SHUTTER MADE OF THE SAME

BACKGROUND OF THE INVENTION

1. Field of the Invention

The present invention relates to an aluminum alloy material for making a shutter which opens and closes an opening which permits the head access to a recording medium cassette accommodating a micro floppy disk, magneto-optic disk, or optical disk capable of digital recording and reproduction. The present invention relates also to a process for producing said aluminum alloy material and a shutter made of said aluminum alloy material.

2. Description of the Prior Art

A magnetic disk (such as micro floppy disk) for computers is encased in a recording medium cassette made of plastic. Another recording medium of the magnetic type, electrostatic type, or optical type is also encased in a cassette. The cassette has an opening which permits the access of the medium to the head (such as a magnetic head). The opening is closed and opened by a slide shutter. The shutter is designed to close the opening to protect the recording medium (disk) when the cassette is not in use after removal from the equipment.

The shutter has been made chiefly of stainless steel or polymeric synthetic resin. Other minor materials include anodized or colored aluminum or aluminum alloy.

Stainless steel shutters have a disadvantage of lacking affinity for printing ink. Hence they cause printed letters to drop off easily due to their poor adhesion property to printing ink. In addition, they involve difficulties in coloring by over-all coating or any other surface treatment; they merely permit letter printing. Therefore, they look poorer than colorful cassettes made of plastic.

Plastic shutters are also poor in printability and need pretreatment such as corona discharge prior to printing. In addition, they have a poor dimensional accuracy and are liable to thermal deformation and static build-up. Static build-up attracts dust and adversely affects the recording medium.

Making the shutter from an aluminum material such as AA5052 alloy and H38 (quenched and tempered material) has been proposed. Aluminum shutters, however, are not strong enough. Moreover, aluminum without a surface finish is easily stained with fingerprints, which cause corrosion. Improvement in corrosion resistance requires anodizing or coloring, which add to the manufacturing steps.

SUMMARY OF THE INVENTION

It is an object of the present invention to provide an aluminum alloy material for making the shutter for recording medium cassettes. The shutter has a high strength, good colorability, and good corrosion resistance, and hardly attracts foreign matter. In addition, it can be produced by comparatively simple steps.

It is another object of the present invention to provide a process for producing the aluminum alloy material mentioned above. It is further another object of the present invention to provide a shutter made of the aluminum alloy material mentioned above.

In order to eliminate the above-mentioned disadvantages involved in conventional aluminum for the shutter of recording medium cassettes, the present inventors carried out a series of investigation in search of an aluminum alloy having optimum strength for shutters and good corrosion resistance and colorability required of shutters. As a result, it was found that the object is achieved by an aluminum alloy material which is produced by coating the surface of an aluminum alloy with a plastic film not thicker than 20 μm, said aluminum alloy containing 3.0–6.0% Mg (by weight) and at least one optional elements of Mn≦1.5%, Cr≦0.3%, Cu≦0.5%, and Ti≦0.1%, with the balance being aluminum and inevitable impurities, and having a tensile strength of 310–410 MPa and a yield strength of 250– 370 MPa.

According to the present invention, the aluminum alloy material is produced by homogenizing an aluminum alloy ingot, hot-rolling (and optionally cold-rolling) the homogenized ingot, performing process annealing, performing final 40–90% cold-rolling, performing or not performing stabilizing heat treatment at not higher than 250° C., and coating the rolled sheet with a plastic paint to form a coating film not thicker than 20 μm, said aluminum alloy containing 3.0–6.0% Mg and at least one optional element of Mn≦1.5%, Cr≦0.3%, Cu≦0.5%, and Ti≦0.1%, with the balance being aluminum and inevitable impurities.

According to the present invention, the aluminum alloy shutter is made of a rolled sheet of the aluminum alloy having the above-mentioned composition and mechanical properties, which is coated with a plastic film preferably not thicker than 5 μm, preferably that of ethylene-acrylic resin, epoxy resin, or epoxy-acrylic resin.

According to the present invention, the aluminum alloy contains Mg and optionally any of Mn, Cr, Cu, and Ti, and has adequate strength and bendability imparted by process annealing, final cold rolling, and stabilizing heat treatment. The aluminum alloy material has good corrosion resistance, resistance to staining with fingerprints, colorability, and slidability. The combination of the aluminum alloy substrate and coating film is responsible for the durable light shutter for the cassette containing a sheet-like recording medium.

BRIEF DESCRIPTION OF THE DRAWINGS

The FIGURE is a plan view of the shutter for the cassette containing a sheet-like recording medium, embodying the present invention.

DESCRIPTION OF THE PREFERRED EMBODIMENTS

The following is the reason why the amounts of the components of the aluminum alloy are restricted as mentioned above. Mg promotes work hardening by cold rolling and improves the strength of the material. Its content should preferably be 3.0–6.0%. An amount less than 3.0% is not enough to impart sufficient strength to the aluminum alloy. An amount in excess of 6.0% has an adverse effect on rolling and bendability. (Bendability is necessary for the shutter to undergo bending (90°-OR bend) into a U-shape that fits the cassette.)

Like Mg, Mn also increases the strength of the material. It is an optional component. Its content should preferably be not more than 1.5%. An amount in excess of 1.5% has an adverse effect on bendability. Cr suppresses the stress corrosion cracking of the Mg-containing aluminum alloy. It is an optional component. Its content should preferably be not more than 0.3%. Cr in excess of 0.3% gives rise to a coarse intermetallic compound of $Al_7Cr$, which has an adverse effect on bendability.

Cu increases the strength of the material. It also protects the material from decreasing in strength when the coating film is baked. It is an optional component. Its content should preferably be not more than 0.5%. Cu in excess of 0.5% has an adverse effect on rollability, bendability, and corrosion resistance. Ti renders the structure of the ingot fine and also renders the properties of the material uniform. It is an optional component. Its content should preferably be not more than 0.1%. Ti in excess of 0.1% gives rise to a coarse intermetallic compound at the time of casting, which has an adverse effect on the bendability of the material.

According to the present invention, the aluminum alloy material should have a tensile strength of 310–410 MPa and a yield strength of 250–370 MPa and should be coated with a plastic film not thicker than 20 μm, preferably not thicker than 5 μm. This condition is necessary for the aluminum alloy material to have high strength, good corrosion resistance, colorability, low weight, bendability, and sliding properties, which are required of the shutter. (Bendability is necessary when the shutter is fitted to the cassette. Sliding properties are necessary after the shutter has been fitted to the cassette.) If the strength and coating thickness are outside the specified range, the desired performance will not be achieved.

The strength and bendability (90°-OR bend) required of the shutter are attained by the process annealing (prior to the final cold rolling) and the 40–90% final cold rolling, or by the stabilizing heat treatment at not higher than 250° C., preferably at 120°–200° C. The process annealing should be carried out at higher than the recrystallization temperature, preferably not lower than 350° C., so that the material undergoes recrystallization prior to the final cold rolling. Final cold rolling with a reduction lower than 40% will not produce sufficient strength. Final cold rolling with a reduction higher than 90% will be unstable. The stabilizing heat treatment will not produce the desired strength invariably if the treating temperature is lower than 120° C. Conversely, the stabilizing heat treatment will lower the strength if the treating temperature is higher than 250° C.

After the stabilizing heat treatment, the rolled sheet of the aluminum alloy is coated with a plastic paint to form a coating film not thicker than 20 μm, preferably not thicker than 5 μm and more preferably not thicker than 3 μm. Preferred examples of the plastic paint include an acrylic resin paint (prepared by incorporating an ethylene-acrylate copolymer with an epoxy cross-linking agent), an epoxy resin paint, and an epoxy-acrylic resin paint. The paint coating should be preceded by chromate phosphate treatment (10–35 mg/m$^2$) or any other pretreatment which forms a primer coating containing chromium ions, zirconium ions, or titanium ions. The plastic paint may optionally be colored with a pigment and dye. The colored paint coating makes the shutter more colorful than the conventional stainless steel shutters. To make the shutter look more colorful, it is recommended that the coating film be thicker than 5 μm although it is slightly poor in adhesion. The plastic coating film contributes to the slidability of the shutter fitted to the cassette and functions as a lubricant when the shutter is bent to be fitted to the cassette. The latter reduces the wear of the bending tool. In addition, the plastic coating film permits a volatile light oil to be used as a lubricant for bending.

Oilless bending would be possible if the plastic coating film is incorporated with wax. Examples of the wax include vegetable wax (such as carnauba wax), animal wax (such as lanolin), petroleum wax (such as paraffin wax and microcrystalline wax), synthetic hydrocarbon (such as polyethylene wax), and modified wax (such as paraffin wax derivative and microcrystalline wax derivative). Wax improves the lubricity and workability in proportion to its content. However, an excess amount of wax would ooze out when the coating film cures, which adversely affects the printability of the coating film. According to the present invention, the plastic coating film should preferably be formed from an epoxy-acrylic resin incorporated with less than 3% inner wax. It provides good workability, good printability, and good ink adhesion.

The final cold rolling may be carried out by using a grinding roll, shot dull roll, or laser dull roll so that the rolled sheet has a surface roughness of $R_a$ of 0.2–1.5 μm or a regular pattern of minute annular grooves with $R_a$ not more than 1 μm. The laser dull roll, for example, has a regular pattern composed of minute annular grooves with an outside diameter of 200 μm and $R_a$ not more than 1 μm which are etched by a laser beam. Such a roughened surface provides good film adhesion, improves bendability, and imparts a good appearance.

EMBODIMENTS

The invention will be described with reference to the following Examples and Comparative Examples.

EXAMPLE 1

An ingot was prepared from an aluminum alloy shown in Table 1 by melting and continuous casting in the usual way. After homogenizing heat treatment at 500° C. for 8 hours, the ingot was made into a 2-mm thick sheet by hot rolling.

The hot rolled sheet was annealed at 380° C. for one hour, then finally cold rolled to a thickness of 0.185 mm. The sheet underwent stabilizing heat-treatment at 160° C. for 1 hour. After the final cold rolling, a portion of the sheet was passed through shot dull rolls or laser dull rolls to impart the desired surface finish. The rolled sheet underwent chromate phosphate treatment (T-Cr 20 mg/m$^2$). It was finally coated with a plastic paint to give a coating film of a varied thickness.

TABLE 1

| | Composition (wt %) | | | | | |
|---|---|---|---|---|---|---|
| No. | Mg | Mn | Cu | Cr | Ti | Al |
| 1 | 4.53 | 0.36 | 0.06 | 0.07 | 0.03 | balance |
| 2 | 3.04 | 1.50 | 0.40 | 0.05 | 0.05 | balance |
| 3 | 5.57 | 0.06 | 0.02 | 0.21 | 0.03 | balance |

The thus obtained sample was tested for tensile properties using a JIS No. 5 specimen. The results were compared with those of an uncoated sample. The sample was also tested for bendability by 90°-OR bend, with the bend radius being equal to the sheet thickness. The bend was checked for cracking and peeling of coating film. The sample was further tested for printability, corrosion resistance, and strength. Printability was evaluated in terms of ink adhesion after silk screen printing and UV curing. Corrosion resistance was evaluated by a salt spray test (for 96 hours) according to JIS. Table 2 shows the conditions under which the sample was prepared, the tensile properties before coating, and the coating thickness. Table 3 shows the results of the measurements and evaluation.

TABLE 2

| Run No. | Alloy No. | Tensile properties before coating: Tensile strength (MPa) | Yield strength (MPa) | Elongation (%) | Surface state: Rolling roll | Surface roughness $R_a$ (μm) | Plastic coating: Kind | Thickness (μm) |
|---|---|---|---|---|---|---|---|---|
| 1 | 1 | 361 | 288 | 7 | normal | 0.32 | ethylene-acrylic | 3 |
| 2 | 1 | 364 | 291 | 7 | normal | 1.46 | ethylene-acrylic | 3 |
| 3 | 1 | 361 | 288 | 7 | normal | 0.32 | ethylene-acrylic | 2 |
| 4 | 1 | 362 | 290 | 7 | normal | 0.97 | epoxy-acrylic | 2 |
| 5 | 1 | 361 | 288 | 7 | normal | 0.32 | epoxy | 2 |
| 6 | 1 | 361 | 288 | 7 | S/D | 0.73 | epoxy-acrylic | 2 |
| 7 | 1 | 361 | 288 | 7 | R/D | 0.53 | ethylene-acrylic | 2 |
| 8 | 2 | 331 | 264 | 8 | normal | 0.33 | ethylene-acrylic | 2 |
| 9 | 3 | 377 | 306 | 6 | normal | 0.30 | epoxy-acrylic | 2 |

Note: normal: grinding roll, S/D: shot dull roll, R/D: laser dull roll

TABLE 3

| Run No. | Tensile properties after coating: Tensile strength (MPa) | Yield strength (MPa) | Elongation (%) | Peeling of coating film | Bendability (cracking) | Printability (adhesion) | Corrosion resistance | Product strength |
|---|---|---|---|---|---|---|---|---|
| 1 | 359 | 285 | 7 | none | none | good | good | good |
| 2 | 361 | 286 | 7 | none | none | good | good | good |
| 3 | 359 | 285 | 7 | none | none | good | good | good |
| 4 | 361 | 286 | 7 | none | none | good | good | good |
| 5 | 359 | 285 | 7 | none | none | good | good | good |
| 6 | 359 | 285 | 7 | none | none | good | good | good |
| 7 | 359 | 285 | 7 | none | none | good | good | good |
| 8 | 332 | 263 | 8 | none | none | good | good | good |
| 9 | 373 | 302 | 7 | none | none | good | good | good |

It is noted from Table 3 that the sample in this example remains almost unchanged in its good mechanical properties (tensile strength) before and after coating. It is also noted that the sample is superior in coating film adhesion, bendability, printability, corrosion resistance, and product strength.

EXAMPLE 2

An ingot was prepared from an aluminum alloy shown in Table 1 by melting and continuous casting in the usual way. The ingot was rolled into a 0.185 mm thick sheet by the same steps as in Example 1. Incidentally, Sample No. 20 was produced from material No. 1 without homogenizing heat treatment. Samples Nos. 16 and 17 were given a rough surface by dull rolls in the final cold rolling. Samples Nos. 1 to 19 were coated after the stabilizing heat treatment, and Sample No. 20 was coated after the final cold rolling, with an epoxy-acrylic plastic paint to form a 2-μm thick coating film in the same manner as in Example 1. The thus obtained samples were tested in the same manner as in Example 1. Table 4 shows the conditions under which the samples were prepared. Table 5 shows the test results.

TABLE 4

| Run No. | Alloy No. | Manufacturing conditions: Reduction of final cold-rinter (%) | Temperature of intermediate annealing (°C.) | Finishing roll | Temperature of stabilizing heat-treatment (°C.) | Surface roughness Ra (μm) | Coating thickness (μm) |
|---|---|---|---|---|---|---|---|
| 10 | 1 | 40 | 380 | normal | 160 | 0.32 | 2 |
| 11 | 1 | 55 | 380 | normal | 160 | 0.32 | 2 |
| 12 | 1 | 75 | 380 | normal | 160 | 0.29 | 2 |
| 13 | 1 | 90 | 380 | normal | 160 | 0.30 | 2 |
| 14 | 1 | 55 | 380 | normal | 120 | 0.31 | 2 |
| 15 | 1 | 55 | 380 | normal | 200 | 0.31 | 2 |
| 16 | 1 | 40 | 380 | S/D | 160 | 0.73 | 2 |
| 17 | 1 | 40 | 380 | R/D | 160 | 0.54 | 2 |
| 18 | 2 | 55 | 380 | normal | 160 | 0.33 | 2 |
| 19 | 3 | 55 | 380 | normal | 160 | 0.33 | 2 |
| 20 | 1 | 55 | 380 | normal | — | 0.32 | 2 |

Note: normal: grinding roll, S/D: shot dull roll, R/D: laser dull roll

TABLE 5

| Run No. | Tensile properties: Before coating: Tensile strength (MPa) | Yield strength (MPa) | Elongation (%) | After coating: Tensile strength (MPa) | Yield strength (MPa) | Elongation (%) | Peeling of coating film | Bendability (cracking) | Printability (adhesion) | Corrosion resistance | Product strength |
|---|---|---|---|---|---|---|---|---|---|---|---|
| 10 | 315 | 260 | 9 | 312 | 254 | 10 | none | none | good | good | good |
| 11 | 335 | 282 | 7 | 330 | 278 | 7 | none | none | good | good | good |
| 12 | 393 | 360 | 6 | 386 | 354 | 6 | none | none | good | good | good |
| 13 | 417 | 374 | 4 | 411 | 366 | 4 | none | none | good | good | good |
| 14 | 347 | 286 | 6 | 342 | 283 | 6 | none | none | good | good | good |
| 15 | 330 | 275 | 8 | 327 | 272 | 8 | none | none | good | good | good |
| 16 | 317 | 250 | 8 | 313 | 246 | 9 | none | none | good | good | good |
| 17 | 315 | 248 | 8 | 311 | 244 | 9 | none | none | good | good | good |
| 18 | 304 | 235 | 8 | 299 | 231 | 9 | none | none | good | good | goocl |
| 19 | 339 | 268 | 7 | 334 | 262 | 8 | none | none | good | good | good |
| 20 | 387 | 369 | 4 | 342 | 309 | 6 | none | none | good | good | good |

It is noted from Table 5 that the sample in this example remains almost unchanged in its good mechanical properties before and after coating. It is also noted that the sample is superior in coating film adhesion, bendability, printability, and corrosion resistance, and the shutter has sufficient strength.

EXAMPLE 3

Blanks for the shutter were punched out from samples Nos. 3, 8, and 9 shown in Table 2 in Example 1. FIG. 1 shows the blank (1) which has an opening (2). The blanks were tested for bendability (90°-OR bend). It was found by visual inspection that the edges of the blanks are free of burrs and the coating film was not peeled by bending.

Comparative Example 1

Ingots were prepared respectively from an aluminum alloy No. 1 shown in Table 1 in Example 1 and an aluminum alloy shown in Table 6 by melting and continuous casting in the usual way. Each ingot was rolled into a sample by the same steps as in Example 1. The samples were tested in the same manner as in Example 1. Table 7 shows the manufacturing conditions, the tensile properties before coating, and the coating thickness. Table 8 shows the test results. Incidentally, the data outside the range specified by the present invention are underlined.

TABLE 6

| Run No. | Composition (wt %): Mg | Mn | Cu | Cr | Ti | Al |
|---|---|---|---|---|---|---|
| 4 | 2.36 | 0.05 | 0.03 | 0.05 | 0.02 | balance |

TABLE 7

| Run No. | Alloy No. | Tensile properties before coating: Tensile strength (MPa) | Yield strength (MPa) | Elongation (%) | Surface state: Rolling roll | Surface roughness $R_a$ (μm) | Paint: Kind | Thickness (μm) |
|---|---|---|---|---|---|---|---|---|
| 1 | 1 | 362 | 291 | 7 | normal | 0.32 | no coating | — |
| 2 | 4 | 283 | 244 | 8 | normal | 0.34 | ethylene-acrylic | 2 |

TABLE 8

| Run No. | Tensile properties after coating: Tensile strength (MPa) | Yield strength (MPa) | Elongation (%) | Peeling of coating film | Bendability (cracking) | Printability | Corrosion resistance |
|---|---|---|---|---|---|---|---|
| 1 | 359 | 285 | 7 | — | none | cissing | corroded |
| 2 | 280 | 243 | 8 | none | none | good adhesion | not corroded |

It is noted from Table 8 that Sample No. 1 is poor in printability because it is not given the plastic coating which is essential in the present invention. It is also noted that, because of the low Mg content, Sample No. 2 is poor in mechanical properties after stabilizing heat treatment and tensile properties after coating. It lacks the strength required of the shutter.

Comparative Example 2

Ingots were prepared respectively from an aluminum alloy No. 1 shown in Table 1 in Example 1 and an aluminum alloy No. 4 shown in Table 6 in Comparative Example 1 by melting and continuous casting in the usual way. Each ingot was rolled into a sample by the same steps as in Example 2. The samples were tested in the same manner as in Example 2. Table 9 shows the manufacturing conditions, and Table 10 shows the test results. Incidentally, those data outside the range specified by the present invention are underlined.

TABLE 9

| | | Manufacturing conditions | | | | | |
|---|---|---|---|---|---|---|---|
| Run No. | Alloy No. | Reduction of final cold rolling (%) | Temperature of process annealing (°C.) | Finishing roll | Surface roughness $R_a$ (μm) | Temperature of stabilizing heat-treatment (°C.) | Coating thickness (μm) |
| 4 | 1 | 55 | 200 | normal | 0.32 | 160 | 2 |
| 5 | 1 | 55 | 380 | normal | 0.32 | 260 | 2 |
| 6 | 1 | 35 | 380 | normal | 0.31 | 160 | 2 |
| 7 | 1 | 93 | 380 | normal | 0.30 | 160 | 2 |
| 8 | 4 | 55 | 380 | normal | 0.34 | 160 | 2 |
| 9 | 1 | 55 | 380 | normal | 0.31 | 160 | 10 |
| 10 | 1 | 55 | 380 | normal | 1.73 | 160 | 3 |

TABLE 10

| | Mechanical properties | | | | | | | | | | | |
|---|---|---|---|---|---|---|---|---|---|---|---|---|
| | Before coating | | | After coating | | | | | | | | |
| Run No. | Tensile strength (MPa) | Yield strength (MPa) | Elongation (%) | Tensile strength (MPa) | Yield strength (MPa) | Elongation (%) | Peeling of coating film | Bendability (cracking) | Printability (adhesion) | Product strength | Corrosion resistance | Surface quality |
| 4 | 438 | 431 | 1 | 242 | 373 | 4 | none | yes | good | good | good | good |
| 5 | 306 | 201 | 14 | 305 | 200 | 14 | none | none | good | poor | good | good |
| 6 | 297 | 241 | 10 | 289 | 233 | 11 | none | none | good | poor | good | good |
| 7 | 426 | 380 | 3 | 415 | 373 | 4 | none | yes | good | good | good | good |
| 8 | 283 | 244 | 8 | 282 | 242 | 9 | none | none | good | poor | good | good |
| 9 | 335 | 282 | 7 | 330 | 278 | 7 | slight | none | good | good | good | good |
| 10 | 332 | 281 | 7 | 330 | 277 | 7 | none | none | good | good | good | rough |

It is noted from Table 10 that the comparative samples which do not meet the conditions of the present invention are not satisfactory for shutters. Sample No. 4 has such a high tensile strength (because the temperature of process annealing was too low to bring about recrystallization) that it is poor in bendability. Sample No. 5 has an insufficient strength because the temperature for stabilizing heat treatment was excessively high. Sample No. 6 is poor in mechanical properties and lacks the strength required of shutters, because the reduction of final cold rolling was low. Sample No. 7 has such a high tensile strength (because of the high reduction of final cold rolling) that it is poor in bendability. Sample No. 8 does not acquire sufficient strength after the stabilizing heat treatment because of the low Mg content in the alloy. Sample No. 9 suffered slight peeling because of the thick coating film. Sample No. 10 is not usable because of the rough surface resulting from rolling.

EXAMPLE 4

The sample obtained, after the stabilizing heat treatment, from the aluminum alloy No. 1 in Example 1 was given an undercoating specified below. Then the sample was coated with an epoxy-acrylic paint ("Canliner 100" made by Nippon Paint Co., Ltd.) to form a 2-μm thick coating film.

The coated sample was tested for bendability and coating film adhesion in the same manner as in Example 1. All the samples tested were found to be superior in bendability and film adhesion.

Conversion coating (1): Dipping in a bath (45° C.) of "Alsurf 401/45" (3%/0.8%) made by Nippon Paint Co., Ltd., which formed a chromium-containing film (Cr 20 mg/m$^2$).

Conversion coating (2): Dipping in a bath (50° C.) containing a 2% solution of "XL91-303" made by Nippon Paint Co., Ltd., followed by coating with "Deoxylite 147/148" (12%/12%) made by Nippon Paint Co., Ltd., which, upon drying, formed a zirconium-containing film (Zr 40 mg/m$^2$).

Conversion coating (3): Dipping in a bath (40° C.) containing a 3% solution of "XL91-304" made by Nippon Paint Co., Ltd., which formed a titanium-containing film (Ti 20 mg/m$^2$).

EXAMPLE 5

The sample obtained, after the stabilizing heat treatment, from the aluminum alloy No. 1 in Example 1 was given a phosphate-chromate treatment (T-Cr 20 mg/m$^2$) with "Alsurf 401/45" made by Nippon Paint Co., Ltd. Then the sample was coated with an epoxy-acrylic paint (made by Nippon Paint Co., Ltd.) to form a 2-μm thick coating film by baking at 250° C. for 60 s. The paint contains a varied amount of inner wax (carnauba wax). The coated sample was tested for printability by screen printing of characters with UV-curable ink (R1G) made by Seiko Advance Co., Ltd. The printing ink was cured by irradiation with UV light emitted from a metal halide lamp (120 W/cm) placed 100 mm away. The rate of curing (or the speed of the conveyor) was 3 m/min. The printability (ink adhesion) was evaluated by rubbing the printed letters with a nail ten times. The printed sample was also tested for bendability in the same manner as in Example 1. The results are shown in Table 11.

TABLE 11

| Run No. | Amount of inner wax (%) | Printability | Ink adhesion | Bendability (film peeling) |
|---|---|---|---|---|
| 21 | 0.66 | good | good | none |
| 22 | 1.33 | good | good | none |
| 23 | — | good | good | some |
| 24 | 2.66 | good | good | none |
| 25 | 4.00 | poor | poor | none |
| 26 | 5.33 | poor | bad | none |
| 27 | 6.66 | bad | bad | none |

It is noted from Table 11 that Sample No. 23 (in which the paint contains no. wax) is poor in bendability. It is also noted that Samples Nos. 25 to 27 (in which the paint contains 4% or more wax) are poor in printability (blurred characters) and ink adhesion.

What is claimed is:

1. A shutter for a recording medium cassette comprising an aluminum alloy sheet having a synthetic resin coated thereon at a thickness not greater than 5μ, the aluminum alloy comprising 3.0–6.0 wt. % Mg, aluminum and inevitable impurities and the coated alloy sheet not having the coating crack or delaminate therefrom when the alloy sheet is bent at a 90° outside bend radius, said bend radius being equal to the alloy sheet thickness.

2. The shutter according to claim 1, wherein the aluminum alloy further comprises at least one member selected from the group consisting of up to 1.5 wt. % Mn, up to 0.3 wt. % Cr, up to 0.5 wt. % Cu and up to 0.1 wt. % Ti.

3. The shutter according to claim 1, wherein the aluminum alloy sheet has a surface roughness, $R_a$, of 0.2–1.5μ.

4. The shutter according to claim 1, wherein the synthetic resin is selected from the group consisting of an ethylene-acrylic resin, an epoxy resin and an epoxy-acrylic resin.

5. The shutter according to claim 1, wherein the synthetic resin is an epoxy-acrylic resin containing from 0.5– 3.0 wt. % carnauba wax.

6. The shutter according to claim 1, wherein the alloy consists essentially of 3.0–6.0 wt. % Mg, at least one member selected from the group consisting of up to 1.5 wt. % Mn, up to 0.3 wt. % Cr and up to 0.1 wt. % Ti, aluminum and inevitable impurities.

* * * * *